US010077901B2

(12) United States Patent
Herzog et al.

(10) Patent No.: US 10,077,901 B2
(45) Date of Patent: Sep. 18, 2018

(54) GAS COOKTOP AND APPLIANCE COMPRISING SUCH A GAS COOKTOP

(71) Applicant: Electrolux Appliances Aktiebolag, Stockholm (SE)

(72) Inventors: Michael Herzog, Rothenburg ob der Tauber (DE); Peter Negretti, Forli (IT); Giuseppe Lando, Forli (IT); Filippo Zanetti, Forli (IT); Stefano Versari, Forlimpopoli (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 102 days.

(21) Appl. No.: 15/035,117

(22) PCT Filed: Dec. 18, 2014

(86) PCT No.: PCT/EP2014/078371
§ 371 (c)(1),
(2) Date: May 6, 2016

(87) PCT Pub. No.: WO2015/106920
PCT Pub. Date: Jul. 23, 2015

(65) Prior Publication Data

US 2016/0281981 A1 Sep. 29, 2016

(30) Foreign Application Priority Data

Jan. 16, 2014 (EP) ..... 14151351

(51) Int. Cl.
*F23D 14/46* (2006.01)
*F24C 3/08* (2006.01)
(Continued)

(52) U.S. Cl.
CPC ..... *F23D 14/46* (2013.01); *F23D 14/04* (2013.01); *F23D 14/84* (2013.01); *F24C 3/085* (2013.01)

(58) Field of Classification Search
CPC ..... F23D 14/04; F23D 14/46
(Continued)

(56) References Cited

U.S. PATENT DOCUMENTS 4,694,132 A * 9/1987 Liu ..... H05B 6/6411 108/20
5,272,961 A * 12/1993 Campbell ..... A47J 37/1228 99/353
(Continued)

FOREIGN PATENT DOCUMENTS

CN 1048749 A 1/1991
DE 826060 C 12/1951
(Continued)

OTHER PUBLICATIONS

Chinese Office action issued in counterpart China application No. 201480071314.9, dated Jun. 1, 2017, 14 pages (with translation).
(Continued)

*Primary Examiner* — Avinash Savani
*Assistant Examiner* — Aaron Heyamoto
(74) *Attorney, Agent, or Firm* — Pearne & Gordon LLP

(57) ABSTRACT

The underlying invention in particular is directed to a gas cooktop (1) comprising a cooking area with at least one concentric gas burner (2, 3), wherein at least one of the gas burners (3) of the cooking area is mounted at an off-center position to a platform (4, 7, 16) rotatably attached to the gas cooktop (1) within the cooking area, wherein the platform (4) is mechanically coupled to a drive arrangement in which an actuator is mechanically coupled via a transmission with
(Continued)

the platform (4) so as to enable remote actuation of rotation of the rotatable platform (4) via the drive arrangement.

31 Claims, 7 Drawing Sheets

(51) Int. Cl.
*F23D 14/04* (2006.01)
*F23D 14/84* (2006.01)

(58) Field of Classification Search
USPC ..... 126/39 E
See application file for complete search history.

(56) References Cited

U.S. PATENT DOCUMENTS

2003/0150333 A1* 8/2003 Fischer ..... A47J 31/40 99/279
2004/0221736 A1* 11/2004 Park ..... A21B 7/005 99/348
2013/0276638 A1* 10/2013 Kristlbauer ..... A47J 31/3633 99/295
2014/0231413 A1* 8/2014 Zanetti ..... F24C 3/085 219/621

FOREIGN PATENT DOCUMENTS

| | | | |
|---|---|---|---|
| DE | 9116603 | U1 | 4/1993 |
| EP | 0860659 | A1 | 8/1998 |
| EP | 2589879 | A1 | 5/2013 |
| EP | 2592355 | A1 | 5/2013 |
| FR | 2669101 | A1 | 5/1992 |
| GB | 28826 | A | 3/1938 |
| GB | 482482 | | 3/1938 |
| GB | 482482 | A | 3/1938 |
| GB | 2223303 | A | 4/1990 |
| JP | S5976912 | U | 5/1984 |
| JP | 2009006049 | A | 1/2009 |
| KR | 20100012627 | U | 2/2010 |
| WO | 2008101766 | A1 | 8/2008 |

OTHER PUBLICATIONS

International Search Report issued in PCT/EP2014/078371 dated Feb. 17, 2015, 3 pages.

* cited by examiner

GAS COOKTOP AND APPLIANCE COMPRISING SUCH A GAS COOKTOP

The present invention is directed to a gas cooktop and an appliance comprising a respective gas cooktop. In more details, the present invention is concerned with gas cooktops that allow positional variation of the gas burners arranged within the cooking area of the gas cooktop.

Gas cooktops comprising gas burners that are moveably arranged within the cooking area such that the relative orientation of the ensemble of all gas burners of the cooktop can be modified by rotating at least one of the gas burners are part of a comparatively young field of development. Hence there is still room for improvements of respective gas cooktops, in particular with respect to moving the moveable gas burner within the cooking area.

It is therefore an object of the invention to provide improvements for gas cooktops which comprise one or more rotatable gas burners. In particular it is an object of the invention to provide improvements related to the rotatory movement of the rotatable gas burner(s).

This object is solved by the invention by the features of claim 1 and claim 14. Embodiments of the invention in particular result from the dependent claims.

According to claim 1, a gas cooktop is proposed which comprises a cooking area with at least one concentric gas burner, i.e. a gas burner having gas outlet openings arranged concentrically along the circumference of a burner crown. The burner crown of the concentric gas burner may have a pot-like, i.e. circular cross section.

At least one of the gas burners of the cooking area is mounted, coupled or integrated at an off-center position to a platform, carrier or plate. Off-center in particular shall mean that the center of rotation of the gas burner is displaced or distant from a center axis of the platform.

The platform is rotatably attached to the gas cooktop within the cooking area. The attachment may be such that rotation of the platform together with the gas burner is possible for a given angle, such as for example 90 degrees, 180 degrees and so on.

The platform may have the form of a strip, a section of a circle or ring, or circular plate, respectively rotatably supported on, at or within the cooking area.

The gas burner(s) mounted to the rotatable platform are preferably connected to a gas supply comprising a stationary section coupled fixedly to the cooking area and a gas distribution head articulatedly, i.e. rotatably, coupled to the stationary section.

By providing the articulated distribution head, gas outlet ports thereof and—as the case may be—gas supply lines, in particular flexible gas supply lines, connected to the gas burner for feeding gas thereto, can be rotated in concert with the rotation of the gas burner and platform.

This in particular may improve the service life span of the lines and, beyond that, the overall security, in particular with respect to undesirable gas leakage at moving parts, may be improved.

Rotational movement of the platform and gas burner in particular provides the possibility to rearrange the positional relations between all gas burners of the gas cooktop, i.e. moveable gas burners, and non-moveable, i.e. fixed, gas burners. In this way, adaptation of the arrangement of the gas burners relative to each other and in consideration of the form and/or position of cookware to be placed on the cooking area is possible, at least to some extent.

The inventors have realized that gas cooktops having rotatable gas burners may have or incur problems with moving or rotating platforms to which gas burners may be mounted to. In particular in solutions in which the moveable platforms and gas burners have to be or may be directly rotated by hand, problems with heated sections and burns at fingers or hands of users, or more generally injuries to customers, may be observed. A further identified problem may be unintentional rotations of respective platforms, in particular during cooking. In addition, the inventors have realized that cutting off the gas supply in phases in which the rotatable gas burner, i.e. the platform, is rotated may greatly enhance operational safety of the gas cooktop.

In particular for these or some of these reasons, it is proposed that the platform is mechanically coupled to a drive arrangement, which in particular shall allow remote rotation of the platform, in which drive arrangement an actuator is mechanically coupled via a transmission with the platform so as to enable remote actuation of rotation of the rotatable platform via the drive arrangement. Remote in particular shall mean, that the platform can be rotated without requiring a user to directly touch the platform or gas burner.

Providing the proposed drive arrangement to a gas cooktop the concentric, off-center gas burner mounted to the rotatable platform can be rotated from a remote position not requiring direct contact with the gas burner and/or platform.

In particular, a comparatively safe rotation and handling system for the rotatable gas burner assembly can be provided. In cases where the drive arrangement is designed such that in the idle state it automatically locks rotation of the platform, and thus the burner, user safety can be improved and the danger of product-related injuries of users can greatly be reduced.

In embodiments, the gas cooktop is designed such that two gas burners are mounted or integrated at respective off-center positions to the platform. It may be preferred that the gas burners are aligned on a common line passing through the axis of rotation of the platform.

In embodiments the drive arrangement may comprise as an actuator at least one of a mechanical drive and electric drive.

A respective mechanical drive can be adapted to allow remote manual rotation of the platform. For example the actuator may comprise a knob coupled via a suitable transmission or adapted to be directly coupled to the platform, and implemented for manually rotating the platform may be provided.

Further, an electric motor may be provided for rotating the platform and gas burner, wherein the electric motor may be coupled with the platform via suitable transmission.

Embodiments of possible and adequate transmissions, in principle suitable both for manual and electric operation will be discussed in more details further below. Manual actuators may be of advantage if movement of respective gas burners requires user guided rotation, in particular with respect to speed, rotation angle and others. Electric, in particular automatic or semiautomatic, actuators make it possible to implement the drive arrangement such that the platform and gas burner can be rotated from a remote location without requiring complicate mechanical transmissions between the remote location and platform.

In embodiments, the drive arrangement comprises as a transmission acting between the actuator and platform at least one of a rod-based, screw-based, wire-based, cog-belt-based, gear-based, and friction-wheel-based transmission. Such transmissions, in particular gear-type transmissions, allow comparatively secure and exact rotations of the platform.

Moreover respective transmissions have been found to be particularly robust, and are appropriate for implementing rotations and rotational speeds suitable for rotatable gas burners, in particular with respect to gas supply and gas supply lines.

In addition, most or even all of the proposed transmissions can be made from materials sufficiently temperature stable to withstand temperatures prevailing during gas burner operation.

As a further point, it shall be mentioned that most or all of the proposed transmissions can be implemented in such a way that a rotational movement of the platform, and therefore a positional chance of the gas burner, is only possible by operating the drive arrangement, whereas in all other situations, rotational movements of the platform are blocked. This also enhances operational security as unintentional rotations of the platform and gas burner can be avoided.

Amongst the afore mentioned transmissions, several specific embodiments have been identified that are particularly suitable and appropriate, and qualify for being implemented in a mechanism for driving the rotatable platform, i.e. gas burner mounted to the platform.

In one embodiment, the transmission is a rod-based transmission and comprises a crank-rod. A rotor drive of the actuator is fixedly connected to a first end of the crank rod. Further, a first and second end section of a connecting rod are respectively articulatedly coupled to the platform and a second end of the crank rod. The transmission in this specific embodiment can be implemented comparatively robust and with suitable temperature resistant materials, such that a comparatively reliable drive arrangement can be provided.

The drive connected to the crank-rod may be an electric motor, but may also be implemented as a rotatable shaft coupled to a shaft, knob or button adapted for manual rotation. In case of an electric motor, a button or knob may be provided, preferably in a position distant from the gas burners, which allows remotely controlled back and forth, i.e. clockwise and counterclockwise, rotation of the platform. Preferably, all rotational axes, in particular those of the crank-rod and connecting rod, are oriented vertically relative to the ordinary operational alignment of the gas cooktop.

In a further specific embodiment, the transmission is screw-based and the actuator, preferably implemented as an articulated electric motor, is coupled to and adapted to axially rotate an endless screw around its longitudinal axis. In this embodiment, the endless screw is coupled to a screw nut articulatedly attacked to the rotatable platform.

The coupling of the screw nut to the platform and interaction between the screw nut and endless screw is such that axial rotation of the endless screw is transferred into a linear movement of the screw nut, which linear movement in turn is transferred into a rotational movement of the platform.

The axis of rotation of the endless screw preferably is oriented horizontally relative to the ordinary operational alignment of the gas burner or platform.

The proposed endless screw and nut based transmission provides a comparatively robust and reliably drive, and also allows secure and exact rotation of the platform.

In a further specific embodiment, the transmission is wire or cog-belt based, and the actuator comprises a driving pulley, and a driven pulley, preferably of half-moon shape, is implemented at the platform. Driving pulley and driven pulley in such a configuration preferably are rotatably supported within the cooking area, preferably having vertically oriented axes of rotation. In the present specific example, a wire or cog-belt is coupled both to the driving and driven pulley so as to transfer rotational movement of the driving pulley into a rotational movement of the driven pulley and platform. The pulleys may, on their outer face sides, comprise indentations, grooves or notches having a complementary cross section as compared to the wire and cog-belt, and being adapted to cooperate with a respective wire or cog-belt.

The wire or cog-belt based transmission allows to implement a comparatively easy and light weight, yet robust transmission. Respective transmissions are suitable in particular for manually driven actuators, as they allow comparatively smooth operation and rotation of the platform and gas burner. However, electric drive motors shall also be possible.

In other specific embodiments the transmission is gear-based and comprises a Geneva drive where a star wheel of the Geneva drive is coupled to the platform and a pin wheel of the Geneva drive is coupled to the actuator such that operation of the actuator, i.e. rotation of the pin wheel, results in an intermittent rotation of the star wheel, i.e. platform.

Rotational axes of the pin and star wheels in respective embodiments may be oriented parallel to the axis of rotation of the platform, in particular in parallel to the vertical direction in the ordinary operational alignment of the gas cooktop.

Using a gear based transmission in combination with the Geneva drive allows an intermittent rotation of the platform, in particular of the gas burner.

In particular it is possible by an adequate design of the pin and star wheels, that defined angles of rotation of the platform, and therefore defined angular positions of the rotatable gas burner(s) can be implemented. This in particular is of advantage if a preset number of different angular positions, in W particular optimized positions, of the gas burner(s) shall be provided.

In other specific embodiments, the transmission is friction-wheel based, gear-rack-based or gear-based, i.e. toothed-gear-based, and a drive toothed gear or drive toothed rack or drive friction wheel is coupled to the actuator, and a driven toothed gear or driven toothed rack, or driven friction wheel, respectively, is coupled to the platform. The driving and/or driven gear, rack or wheel in particular may be in the shape of an annular sector or ring, a circular segment, a half-moon, an annular or circular disc and similar. In the present specific embodiment, the driven gear, rack, or wheel and its corresponding counterpart driving gear, rack, or wheel mesh in such a way that a rotational or translational movement of the actuator is transferred into a rotational or translational movement of the corresponding driven gear, rack, or wheel, which is translated into a rotational movement of the platform and gas burner.

The proposed friction-based or gear-based transmissions, in particular the gear-based transmissions, have been found to be comparatively robust, convenient to operate, and reliable in particular in view of their intended use and positions, in particular comparatively close to the gas burner(s), where considerable thermal and also mechanical loads may be applied to the transmission(s).

The actuator in case of the gear-based, rack-based, or wheel-based transmission may be an electric motor or a manual handle or knob for moving a respective drive gear, drive rack or drive friction-wheel.

In case of a manual handle or knob for moving the gear, rack or wheel, the handle or knob may be implemented with a mechanism for locking and unlocking rotational movement thereof, leading to a locking and unlocking function for the rotatable platform. Locking and unlocking may for example be obtained by implementing the handle or knob with two axial positions between which the handle or knob can be shifted in axial direction, wherein in one axial position rotational movement of the actuator is disabled and in the other axial position rotational movement of the actuator is enabled.

In further embodiments, the drive arrangement may comprise a locking arrangement cooperating with the platform and/or drive arrangement in such a way that rotating movements of the platform are disabled in idle phases of the drive arrangement, in particular of the actuator, and are enabled only in active phases of the drive arrangement, in particular actuator. Such a locking mechanism or arrangement greatly contributes to enhanced safety during operations of the rotatable gas burner(s).

The locking mechanism as such may in particular be provided by the drive arrangement as such, for example in case of electric motors, which may be adapted to lock rotational movements in the deactivated state. However, there may be provided separate locking mechanisms, such as locking pins or other locking configurations such as push-locking mechanisms implemented with manual actuators such as handles or knobs.

In embodiments, the locking arrangement may be configured to automatically block or shut off gas supply through a gas supply line to the at least one of the at least one gas burner of the rotatable platform in active phases of the drive arrangement, and to automatically unblock or release gas supply through the gas supply line to the gas burner in idle phases of the drive arrangement, in particular actuator. Providing a mechanism that automatically blocks and releases the gas supply to the rotatable gas burner in dependence of the operational mode of the drive arrangement can greatly enhance secure operation, as unintended leakage of gas during rotational movements of the rotatable gas burner(s) can be greatly avoided.

In variants, the locking arrangement may comprise a linear actor, in particular of mechanical or electro-mechanical type, which is adapted and configured to mesh or release, upon actuation of the linear actuator, a locking pin or locking lever with or from a corresponding toothed or perforated locking member.

The locking member may for example comprise a ring, ring sector, or toothed comb, and may be provided to run along an outer diameter or edge of the rotatable platform.

Further, the locking member in one variant may be mechanically coupled to the platform or external thereto such that engagement or disengagement of the locking pin or lever, mounted either external to the platform or to the platform, with the locking member results in rotational locking or unlocking of the platform.

The locking pin or lever may be coupled to a mechanical element, such as a handle or knob, or to an electric actuator, such as an electric motor, in particular linear drive or actuator.

In case that the locking member is attached to the rotatable platform, the locking pin or lever may be mounted external to the rotatable platform, and vice versa.

Using the proposed locking members and locking arrangements has proven to be effective in avoiding unintentional rotation of the platform and gas burner attached thereto during ordinary operation of the gas cooktop. This greatly improves operational safety.

In a variant, the locking arrangement may comprise an electromechanical actuator for locking and releasing rotation of the platform. A locking member of the electromechanical actuator in this variant may comprise a shape-memory element adapted to interact with a counterpart locking element. The locking element in this case is configured in such a way that rotation of the platform is locked in a first shape memory configuration of the shape-memory element and rotation of the platform is unlocked in a second shape memory configuration of the shape-memory element.

The shape memory element may be operated by means of a separate heating element coupled to and adapted to heat the shape-memory element.

The proposed shape-memory-based solution may provide comparatively accurate and well controllable locking and unlocking of the rotatable platform.

According to claim 14, a cooking appliance is provided, which comprises a gas cooktop that may be configured according to any embodiment and variant as described above. As to advantages of the cooking appliance, reference is made to the description above.

Exemplary and specific embodiments of the invention will now be described in connection with the annexed figures, in which.

Figure 1:
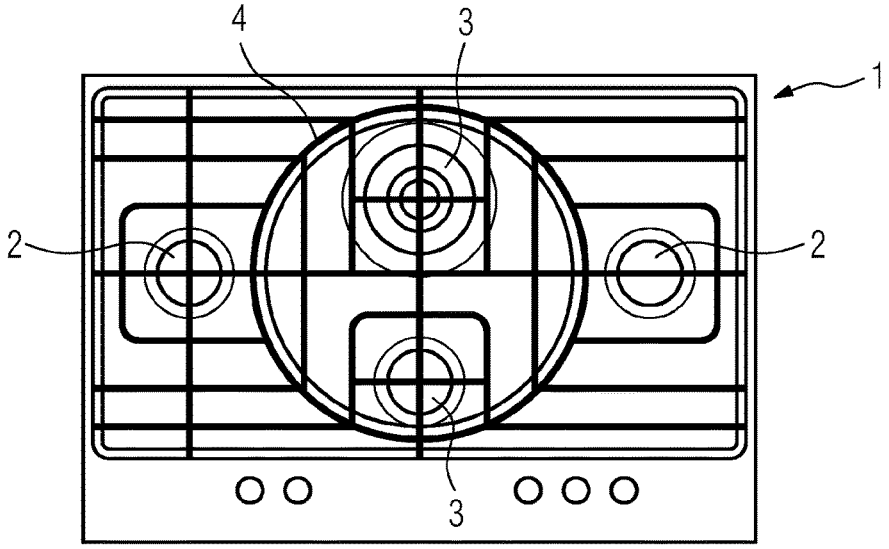
FIG. 1 to FIG. 3 show three different configurations of a gas cooktop comprising a rotatable gas burner.
Figure 2:
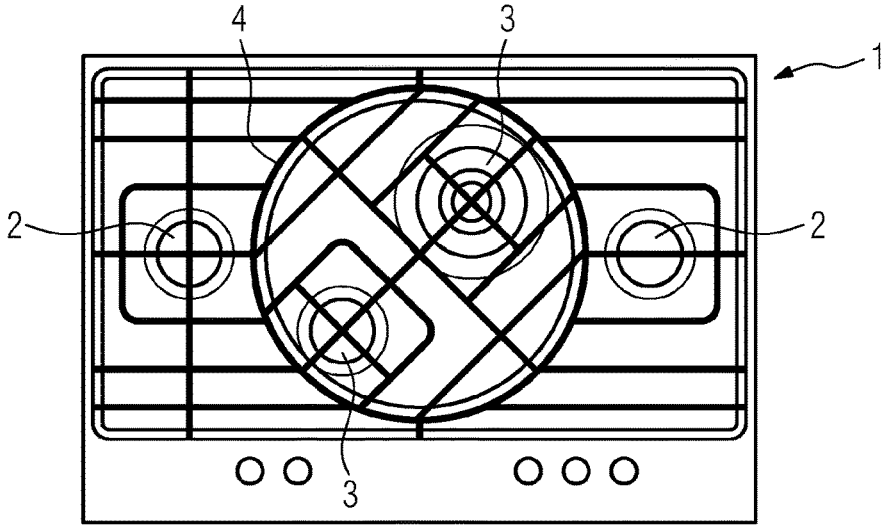
Figure 3:
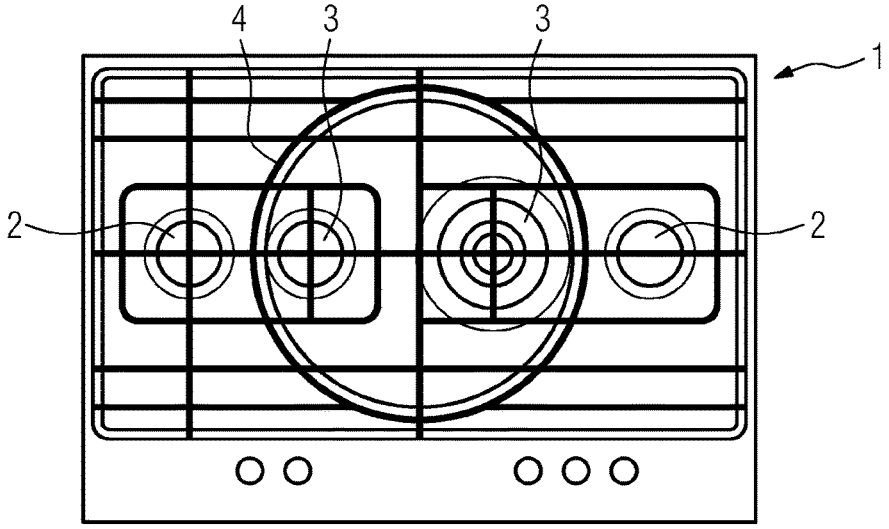

FIG. 1 to FIG. 3 show three different configurations of a gas cooktop 1 which comprises two stationary concentric gas burners 2 and two rotatable concentric gas burners 3. Note that the number of stationary and rotatable gas burners may be selected according to respective requirements any may respectively amount 1, 2, 3, 4 or more. The gas burners may have the same size or power, however in FIGS. 1 to 3, one of the rotatable gas burners 3 is larger than the other ones which are equal in size, i.e. burning power.

The rotatable gas burners 3 are mounted to a rotatable platform 4 that is supported rotatably relative to the cooking area of the gas cooktop 1.

In FIG. 1, the platform 4 is rotated such that a line connecting the rotatable gas burners 3 and a line connecting the stationary gas burners 2 are perpendicular to each other.

In FIG. 2, the rotatable platform 4 is rotated by about 45 degrees clockwise such that the connecting lines cross each other in an angle of about 45 degrees.

In FIG. 3, the rotatable platform 4 is rotated by 90 degrees clockwise such that the connecting lines are aligned with each other, i.e. the gas burners 2, 3 are positioned in a line.

As can be seen from FIGS. 1 to 3, the gas burners 2, 3 can be positioned relative to each other such that different shaped geometries of cooking zones and different arrangements and distances between the gas burners can be set.

Figure 4:
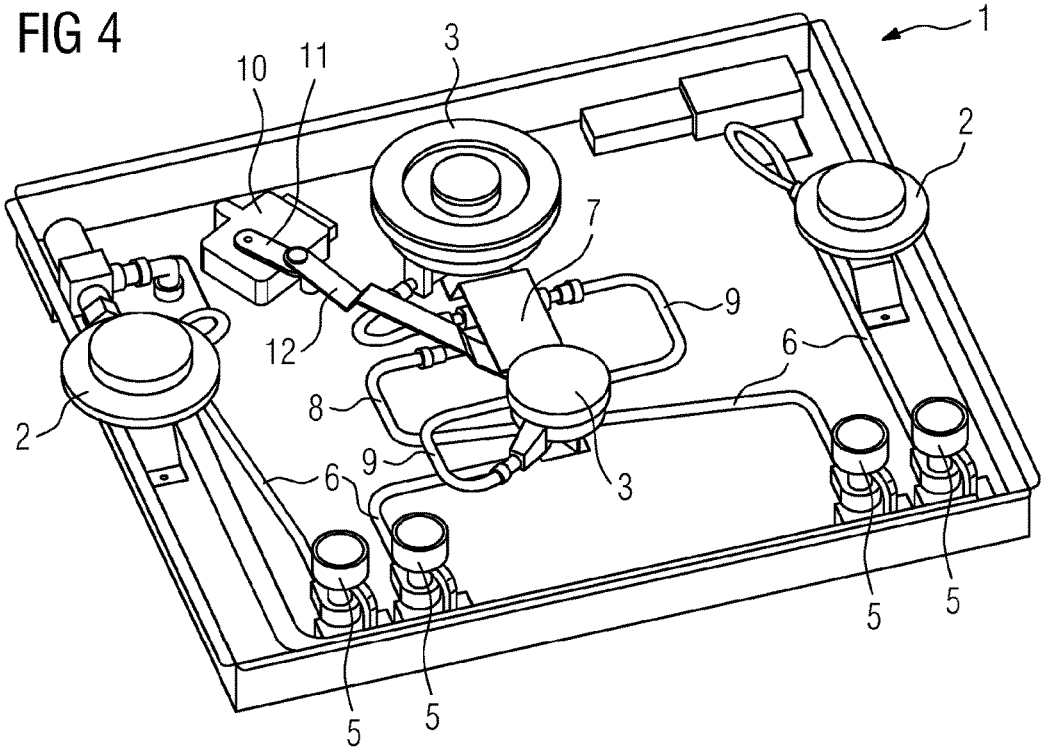
FIG. 4 shows a broken-up view of the gas cooktop with a first drive mechanism in a first configuration.
Figure 5:
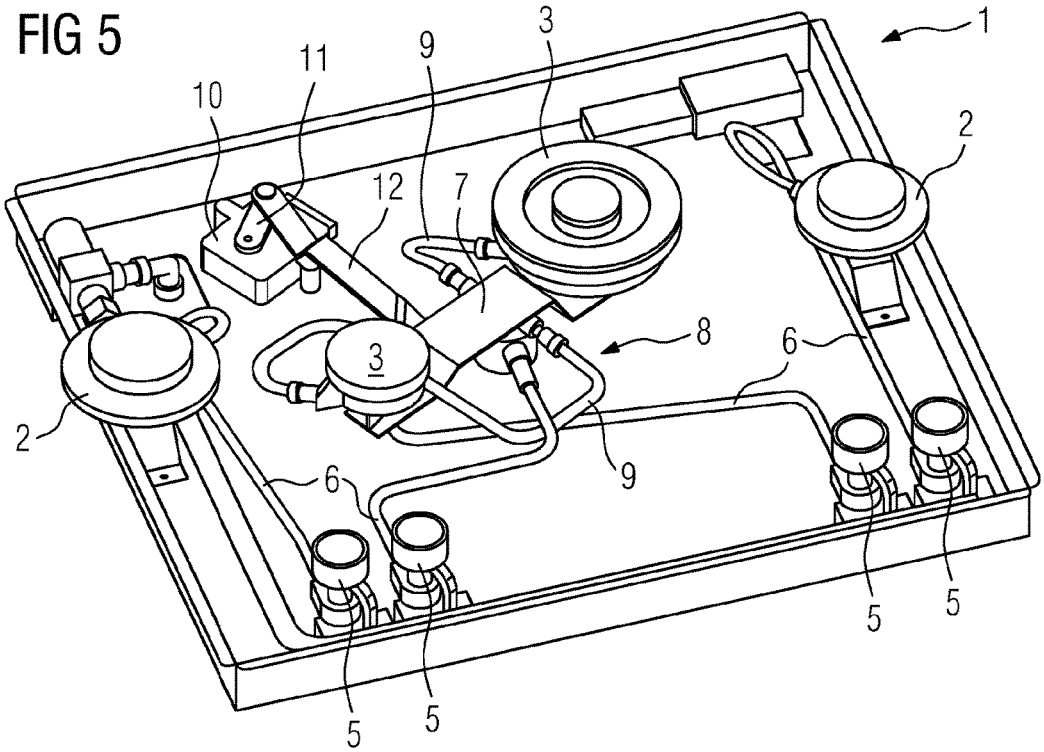
FIG. 5 shows a broken-up view of the gas cooktop with the first drive mechanism in a second configuration.

FIG. 4 shows a broken-up view of the gas cooktop 1 with a first drive mechanism in a first configuration essentially corresponding to FIG. 1, and FIG. 5 shows the gas cooktop in a second configuration essentially corresponding to the configuration and rotational situation of FIG. 2.

The cooktop 1 may comprise gas control units 5, in particular gas control knobs, adapted to control gas supply via gas lines 6 to the gas burners 2, 3.

The rotatable gas burners 3 may, as in the present embodiment, be attached to a rotatable member 7 of linear sheet like form. The rotatable member 7 is rotatably supported within the cooking area and carries on opposite ends a respective one of the rotatable gas burners 3.

Gas supply to the rotatable gas burners 3 is achieved via a gas supply element 8 (see FIG. 5) comprising a stationary base fixedly attached to the base plate of the gas cooktop and a articulated gas distribution head rotatably attached to the stationary base and adapted to be rotatable in concert with the rotatable platform 4. Gas supply lines 9 are provided between the distribution head and gas burners to supply gas from the distribution head to the rotatable gas burners 3.

The rotatable member 7 in the present embodiment is coupled with a first drive mechanism. The first drive mechanism comprises an actuator which in the present case is represented by an electric motor 10.

A drive shaft of the motor 10, having a vertical axis of rotation is coupled to a first end of a crank-rod 11, and a second end of the crank rod 11 is coupled to a connecting rod 12 running between the crank-rod 11 and rotatable element 7 and articulatedly connected at one end to the rotatable element 7.

Actuation of the electric motor 10 is translated into a translational movement of the crank-rod 11 and connecting rod 12, which in turn is translated into a rotational movement of the rotatable member 7 and rotatable gas burners 3.

Actuation of the electric motor may be controlled by a manual switch or knob positioned remotely from the gas burners 2, 3. Hence, a rotational movement of the rotatable member 7 to rearrange the rotatable gas burners 3 within the cooking area can be conducted in a comparatively user friendly and safe way. The user is not required to directly touch the rotatable gas burners 3 or a platform surrounding and accommodating the same, and which may be hot due to preceding operations of the gas burner 2, 3.

The drive mechanism as shown in connection with FIG. 4 and FIG. 5 has proven to be particularly robust and also adequate for operational conditions prevailing during operation of the gas burners 2, 3.

Figure 6:
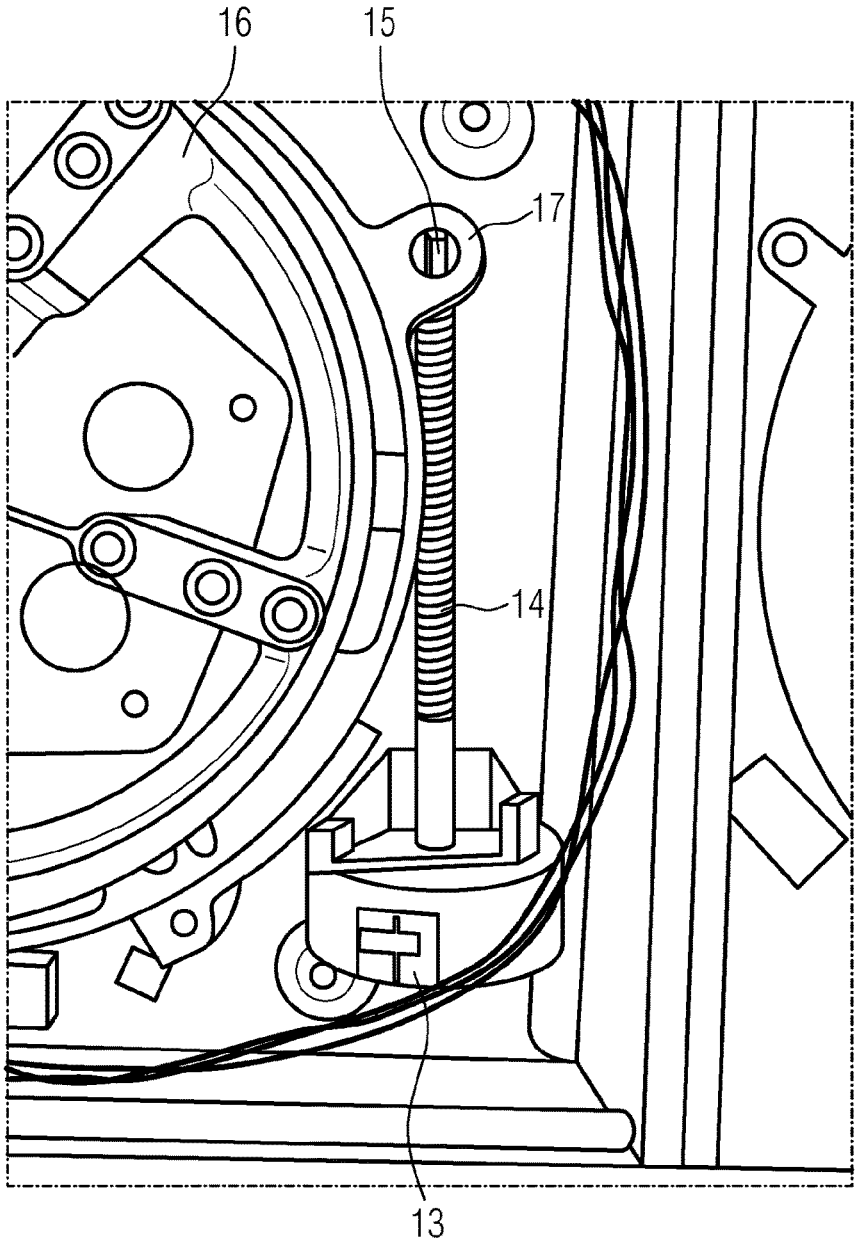
FIG. 6 shows a partial and broken-up bottom view of the gas cooktop with a second drive mechanism.

FIG. 6 shows a partial and broken-up bottom view of the gas cooktop 1 with a second drive mechanism different from the first drive mechanism.

The second drive mechanism comprises a drive motor 13 having a drive shaft coupled to an endless screw 14 such that the drive motor 13 can rotate the screw 14. The endless screw 14 is coupled to a screw nut 15 which in turn is articulatedly coupled to a rotatable platform 16 at an attachment flange 17 protruding radially from the rotatable platform 16.

The second drive mechanism as shown and described in connection with FIG. 6 is comparatively stable and reliable, and in particular is suitable for the conditions prevailing at the gas cooktop 1 during operation of the gas burners 2, 3.

Figure 7:
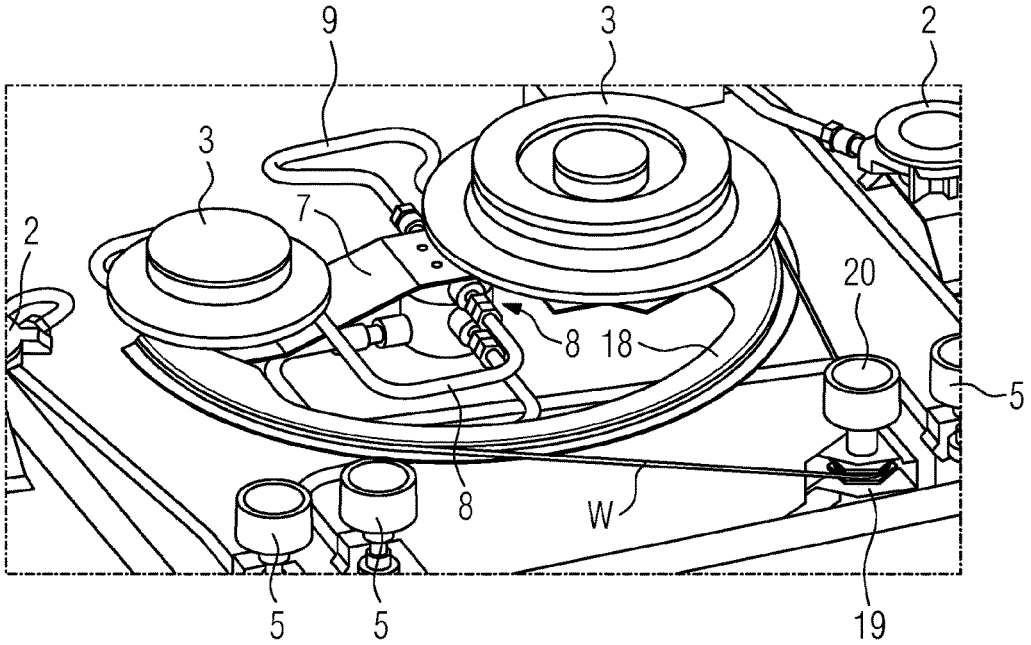
FIG. 7 shows a perspective partial view of the gas cooktop with a third drive mechanism.

FIG. 7 shows a perspective partial view of the gas cooktop with a third drive mechanism. The third drive mechanism is a wire-based or belt-based drive mechanism and comprises a half-moon shaped driven pulley 18 and a drive pulley 19, in the present embodiment coupled to a manual actuator, i.e. actuator knob 20, adapted to manually rotate the drive pulley 19. Rotating the actuator knob 20 is translated via wire transmission W to the half-moon driven pulley 18 to rotate the same and thereby the rotatable gas burners 3. Instead of the manual actuator knob 20, an electrical motor may be provided as an actuator for driving the drive pulley 19.

The half-moon driven pulley 18 in the present case acts as or is part of a mounting platform for the rotatable gas burners 3 and in particular allows rotational movements of the rotatable gas burners 3 by an angle of at least 90 degrees.

Figure 8:
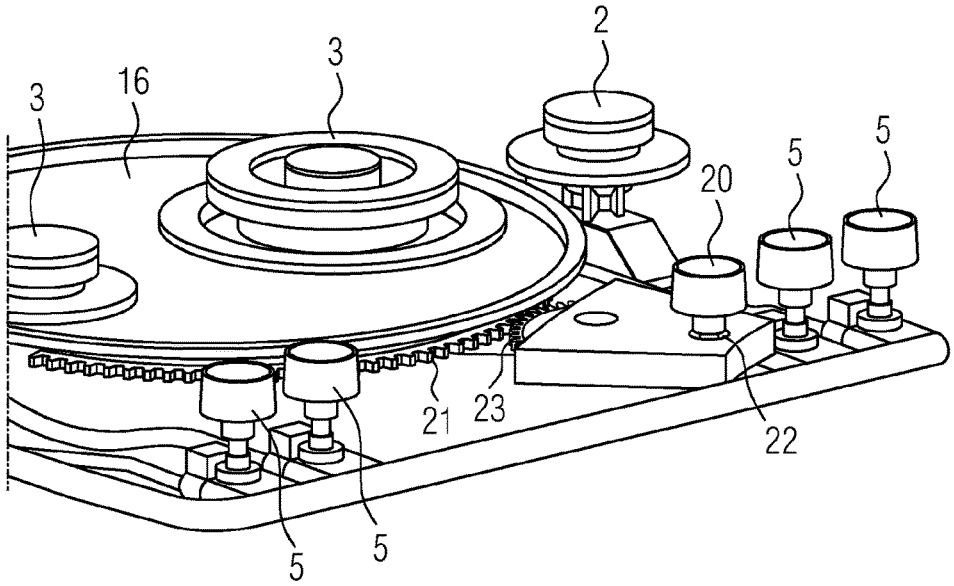
FIG. 8 shows a perspective view of the gas cooktop with a fourth drive mechanism.

FIG. 8 shows a perspective view of the gas cooktop with a fourth drive mechanism. The fourth drive mechanism is a gear-based drive mechanism in which a driven toothed gear 21 or gear section is coupled to the rotatable platform 16 to which the rotatable gas burners 3 are attached to. Further, the fourth drive mechanism comprises a gear-based transmission between a drive toothed gear 22 and the driven toothed gear 21 via an intermediate toothed gear 23.

Note that the drive toothed gear 22 may also be implemented to directly interact with the driven toothed gear 21, i.e. without the intermediate toothed gear 23. The intermediate toothed gear 23 in the present example is provided for the reason that the sense of rotation of the actuator knob 20 coupled to the drive toothed gear 22 and the sense of rotation of the driven toothed gear 21 are unidirectional, which may improve usability.

The manual actuation knob 20 as presented in the present example may also be supplemented by an electric motor coupled to the drive toothed gear 22 for rotating the same, and, via the gear transmission, configured for rotating the rotatable platform 16 together with the rotatable gas burners 3.

Note that the gears may be replaced by toothed racks, in particular curved or bent toothed racks. Alternatively and instead of a gear transmission, a transmission based on friction wheels with a drive friction wheel and a driven friction wheel, and as the case may be with an intermediate friction wheel, may also be used.

Figure 9:
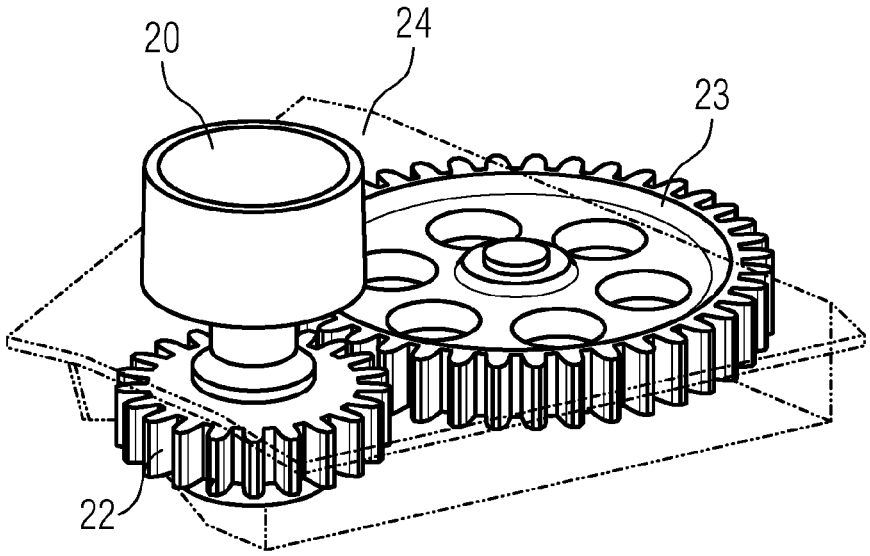
FIG. 9 shows a first optional detail of the gas cooktop of FIG. 9.

FIG. 9 shows a first possible detail of the gear transmission described in connection with FIG. 8. In more detail, FIG. 9 shows the arrangement of drive toothed gear 22 and intermediate toothed gear 23 rotatably supported in a partial enclosure 24.

The actuator knob 20 is also supported in a rotatable manner by the partial enclosure 24.

The partial enclosure 24, as can be seen from FIG. 8, is coupled to the cooking area such that the intermediate toothed gear 23 meshes with the driven toothed gear 21.

Figure 10:
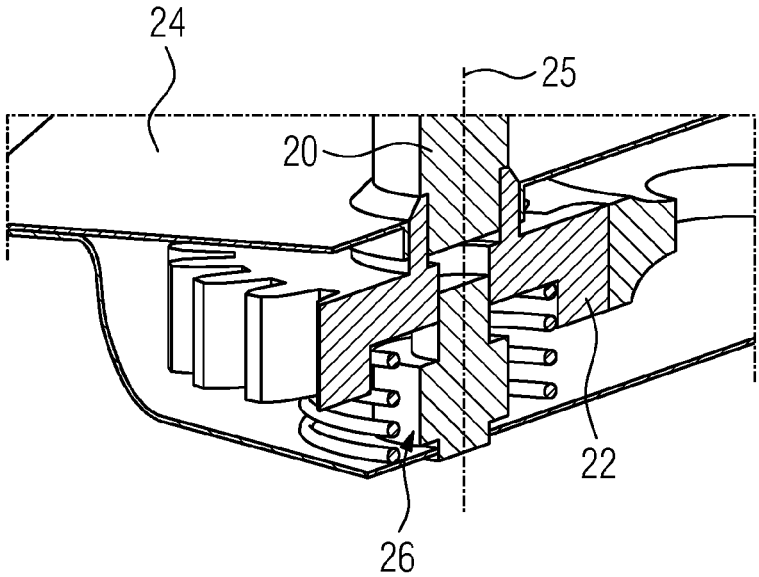
FIG. 10 shows a second optional detail of the gas cooktop of FIG. 9.

In variants, the drive transmission as shown in connection with FIG. 9 may be implemented with a locking mechanism, which is described in more detail in connection with FIG. 10 showing a second possible detail of the gas cooktop of FIG. 9.

In the variant shown in FIG. 10, the actuation knob 20 and a shaft thereof together with the drive toothed gear 22 are adapted to be moveable in axial direction (see double arrow) of the rotation axis 25 of the actuation knob 20 and drive toothed gear 22. In an upper axial position as shown in FIG. 10 rotational movement of the actuation knob 20 is enabled, whereas in a lower axial position (not shown), in which the actuation knob 20 or shaft thereof interacts with a locking member arrangement 26, rotational movement of the actuation knob 20 and therefore of gear transmission or the rotatable platform 16 is disabled. Therefore, in the locked configuration, unintentional rotation of the rotatable platform 16 may be avoided, which greatly contributes to user convenience and safety.

Figure 11:
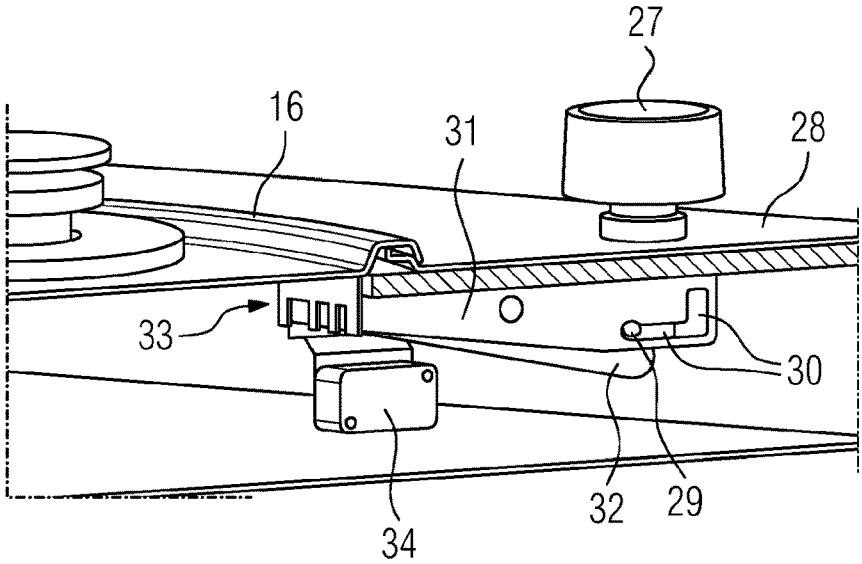
FIG. 11 shows a partial sectional view of the gas cooktop implemented with a first locking mechanism.
Figure 12:
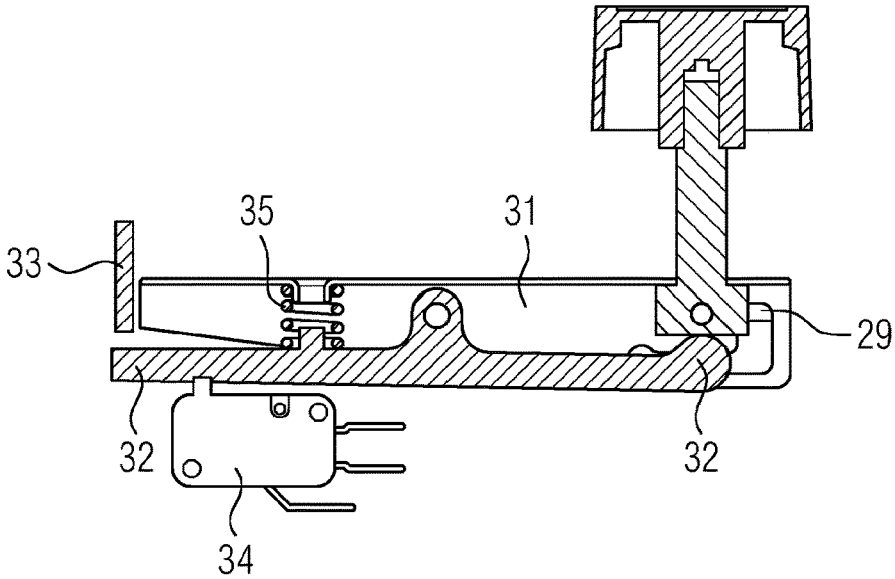
FIG. 12 shows the first type of locking mechanism in FIG. 12 in the unlocked state.

FIG. 11 shows a partial sectional view of a variant of the gas cooktop 1 implemented with a first locking mechanism, and FIG. 12 shows the locking mechanism in more detail. The locking mechanism in the present example is a lever-type locking mechanism. A push and rotary knob 27 is secured in an upper surface plate 28 of the gas cooktop 1. Rotating and/or axially displacing the knob 27 leads to a movement of a pin 29 projecting radially from a shaft of the knob 27 and being guided in an L-shaped slotted hole 30 of a guiding member 31.

In the configuration of FIG. 11, the pin 29 is, by pushing the knob 27 downwards and adequately rotating the knob 27, positioned in a vertical slot section of the slotted hole 30, and a lower end of the shaft of the knob 27 urges one end of the locking rocker 32 downwards. Due to the pivotable attachment of the locking rocker 32 to the guiding member 31, the other end of the locking rocker 32 is pushed upwards and engages a toothed comb 33 attached to the rotatable platform. Hence, rotation of the rotatable platform is locked.

In the configuration of FIG. 12, the knob 27 is actuated in such a way that the pin is at an upper end of the vertical section of the slotted hole 30. In this configuration, the locking rocker 32 is disengaged from the toothed comb 33, and rotational movements of the rotatable platform are enabled and the rotational platform may be rotated by actuation means, in particular as described in any configuration above.

The locking arrangement as shown in FIGS. 11 and 12 may in addition comprise a gas switching unit 34 which is adapted and positioned such that gas supply to at least the rotatable gas burners 3 is stopped in case that rotational movement of the rotatable platform 16 is enabled. The gas switching unit 34 is further adapted in such a way that gas supply to at least the rotatable gas burner is enabled in case that rotational movement of the rotatable platform 16 is blocked. Actuation of the gas switching unit 34 in the present example is accomplished in that the locking rocker 32 interacts with the gas switching unit 34 to shutoff gas supply in case that it does not engage the toothed comb 33.

Note that the locking rocker 32 may be mechanically coupled to the knob 27 in order to perform rocking movements and/or may be spring loaded by a spring 35 urging the locking rocker 32 so that it always follows the axial movement of the knob 27. In the present example, the spring 35 is positioned and adapted to apply a force to the locking rocker 32, which urges the locking rocker 32 to disengage from the toothed comb 33.

Figure 13:
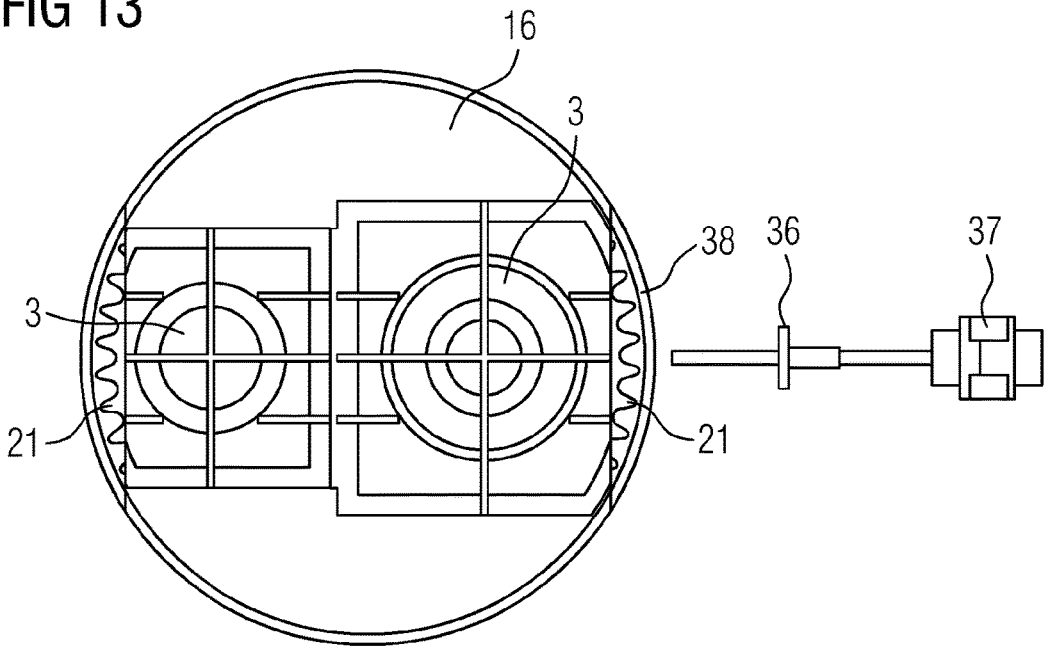
FIG. 13 shows a second type of locking mechanism.

FIG. 13 shows a second type of locking mechanism in which an axially moveable rod 36 may, by the action of an linear actuator 37, be moved forth and back. The direction of movement of the rod 36 in the present example is such that the rod 36 can be moved towards and engaged with one of a plurality of holes provided in a perforated locking ring 38, and away from and disengaged from the perforated locking ring 38 by retracting the rod 36 from the respective hole.

Such a locking mechanism, by adequately designing the holes in the perforated locking ring 38, in particular allows almost freely adjusting any desired graduation of locking positions.

Figure 14:
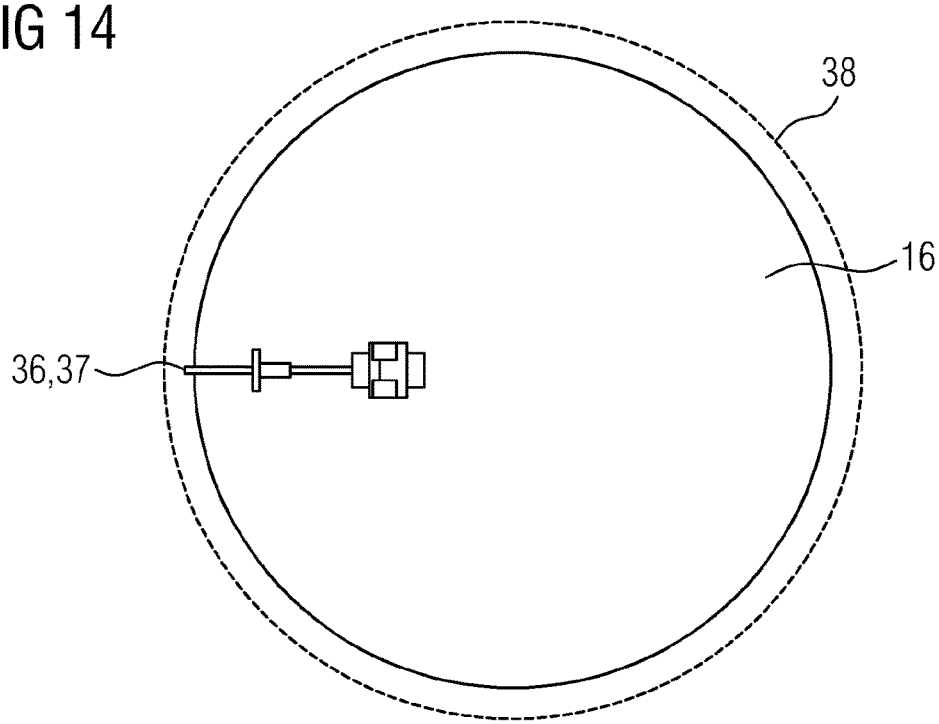
FIG. 14 shows a third locking mechanism.

The third type of locking mechanism as shown in FIG. 14 differs from that of FIG. 13 in that the axially moveable rod 36 and linear actuator 37 are coupled to the rotatable platform 16 instead of being coupled external to the rotatable platform 16 as in FIG. 13. Accordingly, the perforated locking ring 38 in the third locking mechanism is attached external to the rotatable platform, instead of being attached to the rotatable platform 16 as in the second locking mechanism. The function of the third locking mechanism essentially corresponds to that of the second locking mechanism.

In all it becomes clear, that the gas cooktop as proposed by the present invention greatly improves operability and handling of gas cooktops, in particular of rotatable platforms carrying concentric gas burners.

LIST OF REFERENCE NUMERALS

1 gas cooktop
2 stationary gas burner
3 rotatable gas burner
4 rotatable platform
5 gas control units
6 gas line
7 rotatable member
8 gas supply element
9 gas supply line
10 electric motor
11 crank-rod
12 connecting rod
13 drive motor
14 endless screw
15 screw nut
16 rotatable platform
17 attachment flange
18 driven pulley
19 drive pulley
20 actuator knob
21 driven toothed gear
22 drive toothed gear
23 intermediate toothed gear
24 enclosure
25 rotation axis
26 locking member arrangement
27 push and rotary knob
28 upper surface plate
29 pin
30 slotted hole
31 guiding member
32 locking rocker
33 toothed comb
34 gas switching unit
35 spring
36 axially moveable rod
37 linear actuator
38 perforated locking ring
W wire transmission

The invention claimed is:

1. Gas cooktop comprising a cooking area with at least one concentric gas burner, wherein at least one of the gas burners of the cooking area is mounted at an off-center position to a platform rotatably attached to the gas cooktop within the cooking area, wherein the platform is mechanically coupled to a drive arrangement in which an actuator is mechanically coupled via a transmission with the platform so as to enable remote actuation of rotation of the rotatable platform via the drive arrangement, wherein the drive arrangement comprises a locking arrangement cooperating with the platform and/or drive arrangement in such a way that rotating movements of the platform are disabled in idle phases of the drive arrangement and are enabled only in active phases of the drive arrangement, wherein the locking arrangement is further configured to automatically shut off gas supplied through a gas supply line to at least one gas burner of the rotatable platform in active phases of the drive arrangement, and to automatically release gas supplied through the gas supply line to the gas burner in idle phases of the drive arrangement.

2. Gas cooktop according to claim 1, wherein two gas burners are mounted at respective off-center positions to the platform.

3. Gas cooktop according to claim 2, said two gas burners being aligned on a common line passing through the axis of rotation of the platform.

4. Gas cooktop according to claim 1, wherein the drive arrangement comprises as an actuator at least one of a mechanical drive and an electric drive.

5. Gas cooktop according to claim 1, wherein the drive arrangement comprises as a transmission acting between the actuator and platform at least one of a rod-based, screw-based, wire-based, cog-belt-based, gear-based, and friction-wheel-based transmission.

6. Gas cooktop according to claim 5, wherein the transmission is rod-based and comprises a crank-rod, wherein a rotor drive of the actuator is fixedly connected to a first end of the crank-rod, and a first and second section of a connecting rod are respectively articulatedly coupled to the platform and a second end of the crank rod.

7. Gas cooktop according to claim 5, wherein the transmission is screw-based and the actuator is coupled to and adapted to axially rotate an endless screw around its longitudinal axis, wherein the endless screw is coupled to a screw nut articulatedly attached to the platform such that axial rotation of the endless screw is transferred into a rotational movement of the platform.

8. Gas cooktop according to claim 5, wherein the transmission is wire or cog-belt based, and the actuator comprises a driving pulley, and a driven pulley, which is implemented at the platform, wherein a wire or cog-belt is coupled both to the driving and driven pulley so as to transfer rotational movement of the driving pulley into a rotational movement of the driven pulley and platform.

9. Gas cooktop of claim 8, said driven pulley being of a half-moon shape.

10. Gas cooktop according to claim 5, wherein the transmission is gear-based and comprises a Geneva drive where a star wheel of the Geneva drive is coupled to the platform and a pin wheel of the Geneva drive is coupled to the actuator such that operation of the actuator results in an intermittent rotation of the platform.

11. Gas cooktop according to claim 5, wherein the transmission is friction-wheel based, gear-rack-based, or gear-based, wherein a drive toothed gear, or drive toothed rack, or drive friction wheel is coupled to the actuator and a driven toothed gear, or driven toothed rack, or driven friction wheel is coupled to the platform, wherein the driven gear, rack, or wheel and its corresponding driving gear, rack, or wheel mesh in such a way that a rotational or translational movement of the actuator is transferred into a rotational movement of the driving gear in turn causing rotational movement of the platform.

12. Gas cooktop according to claim 1, wherein the locking arrangement comprises a linear actuator adapted and configured to mesh or release, upon actuation of the linear actuator, a locking pin or locking lever with or from a corresponding toothed or perforated locking member running along an outer diameter of the platform and being mechanically coupled to the gas cooktop such that engagement or disengagement of the locking pin or lever with the locking member results in rotational locking or unlocking of the platform.

13. Gas cooktop according to claim 1, wherein the locking arrangement comprises an electro-mechanical actuator for locking and releasing rotation of the platform, wherein a locking member of the actuator comprises a shape-memory element adapted to interact with a counterpart locking element, wherein rotation of the platform is locked in a first shape memory configuration of the shape-memory element and rotation of the platform is unlocked in a second shape memory configuration of the shape-memory element.

14. Cooking appliance comprising a gas cooktop comprising a cooking area with at least one concentric gas burner, wherein at least one of the gas burners of the cooking area is mounted at an off-center position to a platform rotatably attached to the gas cooktop within the cooking area, wherein the platform is mechanically coupled to a drive arrangement in which an actuator is mechanically coupled via a transmission with the platform so as to enable remote actuation of rotation of the rotatable platform via the drive arrangement, wherein the drive arrangement comprises a locking arrangement cooperating with the platform and/or drive arrangement in such a way that rotating movements of the platform are disabled in idle phases of the drive arrangement and are enabled only in active phases of the drive arrangement, wherein the locking arrangement is further configured to automatically shut off gas supplied through a gas supply line to at least one gas burner of the rotatable platform in active phases of the drive arrangement, and to automatically release gas supplied through the gas supply line to the gas burner in idle phases of the drive arrangement.

15. Gas cooktop comprising a cooking area with at least one concentric gas burner wherein at least one of the gas burners of the cooking area is mounted at an off-center position to a platform rotatably attached to the gas cooktop within the cooking area, wherein the platform is mechanically coupled to a drive arrangement wherein the drive arrangement comprises as a transmission acting between an actuator and the platform at least one of a rod-based, screw-based, wire-based, cog-belt-based, gear-based, friction-wheel-based transmission, wherein the actuator is mechanically coupled via the transmission with the platform so as to enable remote actuation of rotation of the rotatable platform via the drive arrangement, and in that the drive arrangement comprises a locking arrangement cooperating with at least one selected from platform and drive arrangement, wherein cooperation is such that rotating movements of the platform are disabled in idle phases of the drive arrangement and are enabled only in active phases of the drive arrangement, wherein the locking arrangement is further configured to automatically shut off gas supplied through a gas supply line to the at least one of the at least one gas burner of the rotatable platform in active phases of the drive arrangement and to automatically release gas supplied through the gas supply line to the gas burner in idle phases of the drive arrangement.

16. Gas cooktop according to claim 15, wherein two gas burners are mounted at respective off-center positions to the platform.

17. Gas cooktop according to claim 15, wherein the drive arrangement comprises as an actuator at least one of a mechanical drive and an electric drive.

18. Gas cooktop according to claim 15, wherein the transmission is rod-based and comprises a crank-rod wherein a rotor drive of the actuator is fixedly connected to a first end of the crank-rod, and a first and second section of a connecting rod are respectively articulatedly coupled to the platform and a second end of the crank rod.

19. Gas cooktop according to claim 15, wherein the transmission is screw-based and the actuator is coupled to and adapted to axially rotate an endless screw around its longitudinal axis, wherein the endless screw is coupled to a screw nut articulatedly attached to the platform such that axial rotation of the endless screw is transferred into a rotational movement of the platform.

20. Gas cooktop according to claim 15, wherein the transmission is wire (W) or cog-belt based, and the actuator comprises a driving pulley, and a driven pulley which is implemented at the platform, wherein a wire (W) or cog-belt is coupled both to the driving and driven pulley so as to transfer rotational movement of the driving pulley into a rotational movement of the driven pulley and platform.

21. Gas cooktop according to claim 15, wherein the transmission is gear-based and comprises a Geneva drive where a star wheel of the Geneva drive is coupled to the platform and a pin wheel of the Geneva drive is coupled to the actuator such that operation of the actuator results in an intermittent rotation of the platform.

22. Gas cooktop according to claim 15, wherein the transmission is friction-wheel based, gear-rack-based, or gear-based, wherein a drive toothed gear, or drive toothed rack, or drive friction wheel is coupled to the actuator and a driven toothed gear, or driven toothed rack, or driven friction wheel is coupled to the platform, wherein the driven gear, rack, or wheel and its corresponding driving gear, rack, or wheel mesh in such a way that a rotational or translational movement of the actuator is transferred into a rotational movement of the driving gear in turn causing rotational movement of the platform.

23. Gas cooktop according to claim 15, wherein the locking arrangement comprises a linear actuator adapted and configured to mesh or release, upon actuation of the linear actuator, a locking pin or locking lever with or from a corresponding toothed or perforated locking member running along an outer diameter of the platform and being mechanically coupled to the gas cooktop such that engagement or disengagement of the locking pin or lever with the locking member results in rotational locking or unlocking of the platform.

24. Gas cooktop according to claim 15, wherein the locking arrangement comprises an electro-mechanical actuator for locking and releasing rotation of the platform, wherein a locking member of the actuator comprises a shape-memory element adapted to interact with a counterpart locking element, wherein rotation of the platform is locked in a first shape memory configuration of the shape-memory element and rotation of the platform is unlocked in a second shape memory configuration of the shape-memory element.

25. Cooking appliance comprising a gas cooktop according to claim 15.

26. Gas cooktop comprising a cooking area with at least one concentric gas burner wherein at least one of the gas burners of the cooking area is mounted at an off-center position to a platform rotatably attached to the gas cooktop within the cooking area, wherein the platform is mechanically coupled to a drive arrangement in which an actuator is mechanically coupled via a transmission with the platform so as to enable remote actuation of rotation of the rotatable platform via the drive arrangement, wherein the drive arrangement comprises a locking arrangement cooperating with the platform and/or drive arrangement in such a way that rotating movements of the platform are disabled in idle phases of the drive arrangement and are enabled only in active phases of the drive arrangement, wherein the drive arrangement comprises as a transmission acting between the actuator and platform at least one of a rod-based, screw-based, wire-based, cog-belt-based, gear-based, friction-wheel-based transmission, wherein the locking arrangement is further configured to automatically shut off gas supplied through a gas supply line to the at least one of the at least one gas burner of the rotatable platform in active phases of the drive arrangement, and to automatically release gas supplied through the gas supply line to the gas burner in idle phases of the drive arrangement, and wherein either the transmission is rod-based and comprises a crank-rod, wherein a rotor drive of the actuator is fixedly connected to a first end of the crank-rod, and a first and second section of a connecting rod are respectively articulatedly coupled to the platform and a second end of the crank rod, or the transmission is screw-based and the actuator is coupled to and adapted to axially rotate an endless screw around its longitudinal axis, wherein the endless screw is coupled to a screw nut articulatedly attached to the platform such that axial rotation of the endless screw is transferred into a rotational movement of the platform or the transmission is wire (W) or cog-belt based, and the actuator comprises a driving pulley, and a driven pulley which is implemented at the platform, wherein a wire (W) or cog-belt is coupled both to the driving and driven pulley so as to transfer rotational movement of the driving pulley into a rotational movement of the driven pulley and platform, or the transmission is gear-based and comprises a Geneva drive where a star wheel of the Geneva drive is coupled to the platform and a pin wheel of the Geneva drive is coupled to the actuator such that operation of the actuator results in an intermittent rotation of the platform, or the transmission is friction-wheel based, gear-rack-based, or gear-based, wherein a drive toothed gear, or drive toothed rack, or drive friction wheel is coupled to the actuator, and a driven toothed gear, or driven toothed rack, or driven friction wheel is coupled to the platform, wherein the driven gear, rack, or wheel and its corresponding driving gear, rack, or wheel mesh in such a way that a rotational or translational movement of the actuator is transferred into a rotational movement of the driving gear in turn causing rotational movement of the platform.

27. Gas cooktop according to claim 26, wherein two gas burners are mounted at respective off-center positions to the platform.

28. Gas cooktop according to claim 26, wherein the drive arrangement comprises as an actuator at least one of a mechanical drive and an electric drive.

29. Gas cooktop according to claim 26, wherein the locking arrangement comprises a linear actuator adapted and configured to mesh or release, upon actuation of the linear actuator, a locking pin or locking lever with or from a corresponding toothed or perforated locking member running along an outer diameter of the platform and being mechanically coupled to the gas cooktop such that engagement or disengagement of the locking pin or lever with the locking member results in rotational locking or unlocking of the platform.

30. Gas cooktop according to claim 26, wherein the locking arrangement comprises an electro-mechanical actuator for locking and releasing rotation of the platform, wherein a locking member of the actuator comprises a shape-memory element adapted to interact with a counterpart locking element, wherein rotation of the platform is locked in a first shape memory configuration of the shape memory element and rotation of the platform is unlocked in a second shape memory configuration of the shape-memory element.

31. Cooking appliance comprising a gas cooktop according to claim 26.

* * * * *